US012050078B2

(12) United States Patent
Underwood et al.

(10) Patent No.: US 12,050,078 B2
(45) **Date of Patent: *Jul. 30, 2024**

(54) RATCHETING MAGAZINE ASSEMBLY

(71) Applicants: James Matthew Underwood, Kennesaw, GA (US); Larry Cullen Underwood, Canton, GA (US)

(72) Inventors: James Matthew Underwood, Kennesaw, GA (US); Larry Cullen Underwood, Canton, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/094,660

(22) Filed: Jan. 9, 2023

(65) Prior Publication Data

US 2023/0168053 A1 Jun. 1, 2023

Related U.S. Application Data

(63) Continuation of application No. 17/345,227, filed on Jun. 11, 2021, now Pat. No. 11,578,937, which is a continuation of application No. 16/378,253, filed on Apr. 8, 2019, now Pat. No. 11,067,351.

(60) Provisional application No. 62/654,657, filed on Apr. 9, 2018.

(51) Int. Cl.
*F41A 9/70* (2006.01)

(52) U.S. Cl.
CPC ..... *F41A 9/70* (2013.01)

(58) Field of Classification Search
CPC ..... F41A 9/70
See application file for complete search history.

(56) References Cited

U.S. PATENT DOCUMENTS

| | | | | | |
|---|---|---|---|---|---|
| 1,804,511 | A | | 5/1931 | Pedersen | |
| 3,226,869 | A | | 1/1966 | Musgrave | |
| 3,772,812 | A | | 11/1973 | Day | |
| 3,906,652 | A | * | 9/1975 | Evans | F41A 9/66 42/88 |
| 4,027,415 | A | * | 6/1977 | Stoner | F41A 9/83 42/50 |
| 4,332,097 | A | * | 6/1982 | Taylor, Jr. | F41A 9/73 89/33.02 |
| 4,676,138 | A | * | 6/1987 | Thompson | F41A 9/76 89/33.14 |
| 4,995,179 | A | * | 2/1991 | Switzer | F41A 9/66 42/50 |
| 5,078,043 | A | * | 1/1992 | Stephens | F41A 21/30 89/14.4 |
| 5,081,778 | A | * | 1/1992 | Switzer | F41A 9/66 42/50 |
| 5,113,605 | A | * | 5/1992 | Kim | F41A 9/71 42/50 |
| 5,284,081 | A | * | 2/1994 | Stoner | F41A 9/31 89/33.17 |
| 5,450,683 | A | * | 9/1995 | Miller, IV | F41A 9/65 42/50 |
| 6,070,352 | A | | 6/2000 | Daigle | |

(Continued)

*Primary Examiner* — Michelle Clement

(57) ABSTRACT

A ratcheting magazine for a firearm includes a main body, a floor plate, and an insert disposed inside the main body. The insert includes a front column of supports, a rear column of supports, and a sliding column of supports. The sliding column of supports includes a plurality of positions relative to the insert such that the sliding column of supports moves linearly relative to the insert.

20 Claims, 14 Drawing Sheets

(56) References Cited

U.S. PATENT DOCUMENTS

| | | | | |
|---|---|---|---|---|
| 7,093,386 | B1 * | 8/2006 | Vieweg | F41A 9/65 42/7 |
| 8,028,455 | B1 | 10/2011 | Battaglia | |
| 8,689,475 | B2 | 4/2014 | Battaglia | |
| 9,103,614 | B2 * | 8/2015 | Froehle | F41A 9/67 |
| 9,194,635 | B1 | 11/2015 | Gibbens et al. | |
| 9,267,749 | B1 * | 2/2016 | Dukart | F41A 9/71 |
| 9,784,512 | B1 | 10/2017 | Harding | |
| 10,066,886 | B2 | 9/2018 | Vilardi et al. | |
| 10,222,153 | B1 | 3/2019 | Harding | |
| 10,228,202 | B2 * | 3/2019 | Jarboe | F41A 9/71 |
| 10,254,063 | B2 * | 4/2019 | Duhon | F41A 9/73 |
| 10,260,827 | B2 | 4/2019 | Mock | |
| 10,288,371 | B2 * | 5/2019 | Maga | F41A 9/67 |
| 10,809,028 | B2 * | 10/2020 | Underwood | F41A 9/65 |
| 10,900,726 | B2 * | 1/2021 | Masarik | F41A 9/62 |
| 10,900,728 | B1 * | 1/2021 | Harding | F41A 9/71 |
| 11,592,250 | B2 * | 2/2023 | No | F41A 9/70 |
| 2007/0199435 | A1 | 8/2007 | Hochstrate et al. | |
| 2010/0126053 | A1 | 5/2010 | Fitzpatrick et al. | |
| 2011/0167695 | A1 * | 7/2011 | Faifer | F41A 9/67 42/50 |
| 2012/0131830 | A1 * | 5/2012 | Froehle | F41A 9/67 42/49.01 |
| 2013/0086834 | A1 | 4/2013 | Battaglia | |
| 2015/0059723 | A1 * | 3/2015 | Tseng | F41B 11/55 124/52 |
| 2016/0102931 | A1 * | 4/2016 | Roberts | F41A 9/75 89/33.02 |
| 2016/0282071 | A1 | 9/2016 | Vilardi et al. | |
| 2017/0138684 | A1 * | 5/2017 | Findlay | F41A 9/65 |
| 2017/0307319 | A1 | 10/2017 | Jarboe | |
| 2018/0180371 | A1 | 6/2018 | Beasley | |
| 2018/0299218 | A1 * | 10/2018 | Myers | F41A 9/70 |
| 2019/0154374 | A1 * | 5/2019 | Myers | F41A 9/70 |
| 2019/0226779 | A1 | 7/2019 | DiChario et al. | |
| 2019/0331444 | A1 * | 10/2019 | Underwood | F41A 9/71 |
| 2019/0353441 | A1 * | 11/2019 | Underwood | F41A 9/70 |
| 2023/0213295 | A1 * | 7/2023 | Masarik | G01D 5/12 42/1.02 |
| 2023/0243610 | A1 * | 8/2023 | Thomele | F41A 9/69 42/50 |

* cited by examiner

RATCHETING MAGAZINE ASSEMBLY

CROSS REFERENCE TO RELATED APPLICATIONS

This application is a continuation of U.S. patent application Ser. No. 17/345,227 ("the '227 application") filed Jun. 11, 2021, which is a continuation of U.S. patent application Ser. No. 16/378,253 ("the '253 application") filed Apr. 8, 2019, which is related to and claims priority benefit from U.S. Provisional Application No. 62/654,657 ("the '657 application"), filed on Apr. 9, 2018. The '227 application, the '253 application, and the '657 application are each hereby incorporated in their entirety by this reference.

FIELD OF THE INVENTION

The field of the invention relates to firearms, particularly methods and devices for magazines of a firearm.

BACKGROUND

Since the advent and standardization of self-contained metallic cartridge ammunition, firearms have included systems and devices for loading and/or storing ammunition. Many modern firearms (including handguns, rifles, carbines, shotguns, etc.) include a magazine for storing ammunition. Magazines may be integral/fixed to the firearm or may be detachable. Different magazine arrangements include tube, box, rotary, drum, casket, pan, helical, saddle-drum, or various other arrangements.

Some anti-firearm laws, such as those enacted in California, ban the sale of many semi-automatic, centerfire rifles or semi-automatic pistols that do not have a fixed magazine. To facilitate loading of fixed magazine firearms, it may be desirable to find alternative devices and methods for loading ammunition that does not include a removable magazine. In addition, in some cases, new ratcheting magazine assemblies may enable faster and more efficient loading of firearms without removable magazines.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a ratcheting magazine for a firearm includes a main body, a floor plate, and an insert disposed inside the main body. The insert includes a front column of supports, a rear column of supports, and a sliding column of supports. The sliding column of supports includes a plurality of positions relative to the insert such that the sliding column of supports moves linearly relative to the insert.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Although the illustrated embodiments shown in FIGS. 1-11B illustrate components of various semi-automatic rifles, the features, concepts, and functions described herein are also applicable (with potential necessary alterations for particular applications) to handguns, rifles, carbines, shotguns, or any other type of firearm. Furthermore, the embodiments may be compatible with various calibers including rifle calibers such as, for example, 5.56×45 mm NATO, 0.223 Remington, 7.62×51 mm NATO, .308 Winchester, 7.62×39 mm, 5.45×39 mm; handgun calibers such as, for example, 9×19 mm, 0.45 ACP, 0.40 S&W, 0.380 ACP; and shotgun calibers such as, for example, 12 gauge, 20 gauge, 28 gauge, 0.410 gauge, 10 gauge, 16 gauge.

Figure 1:
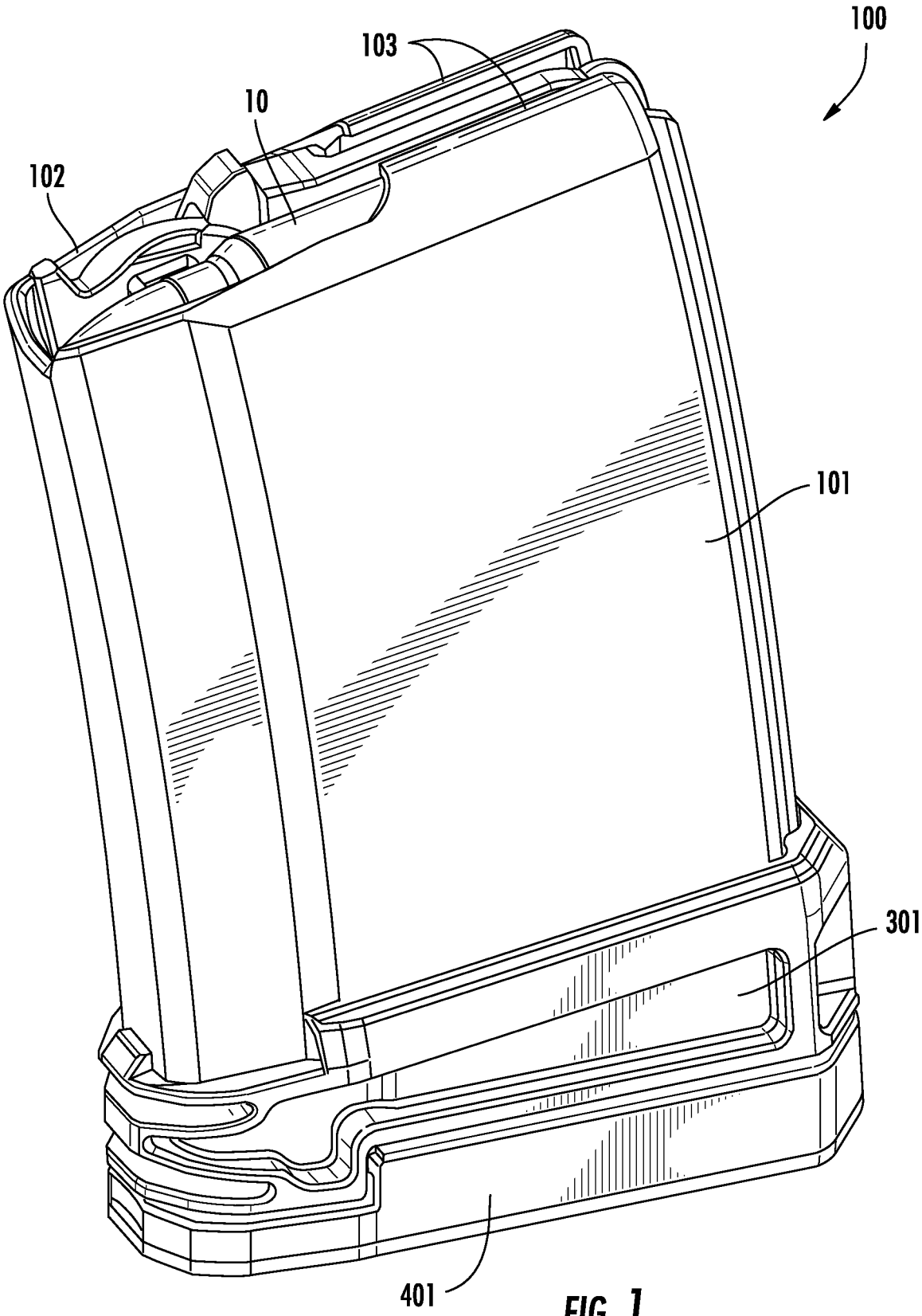
FIG. 1 is a perspective view of a ratcheting magazine, according to certain embodiments of the present invention.
Figure 2A:
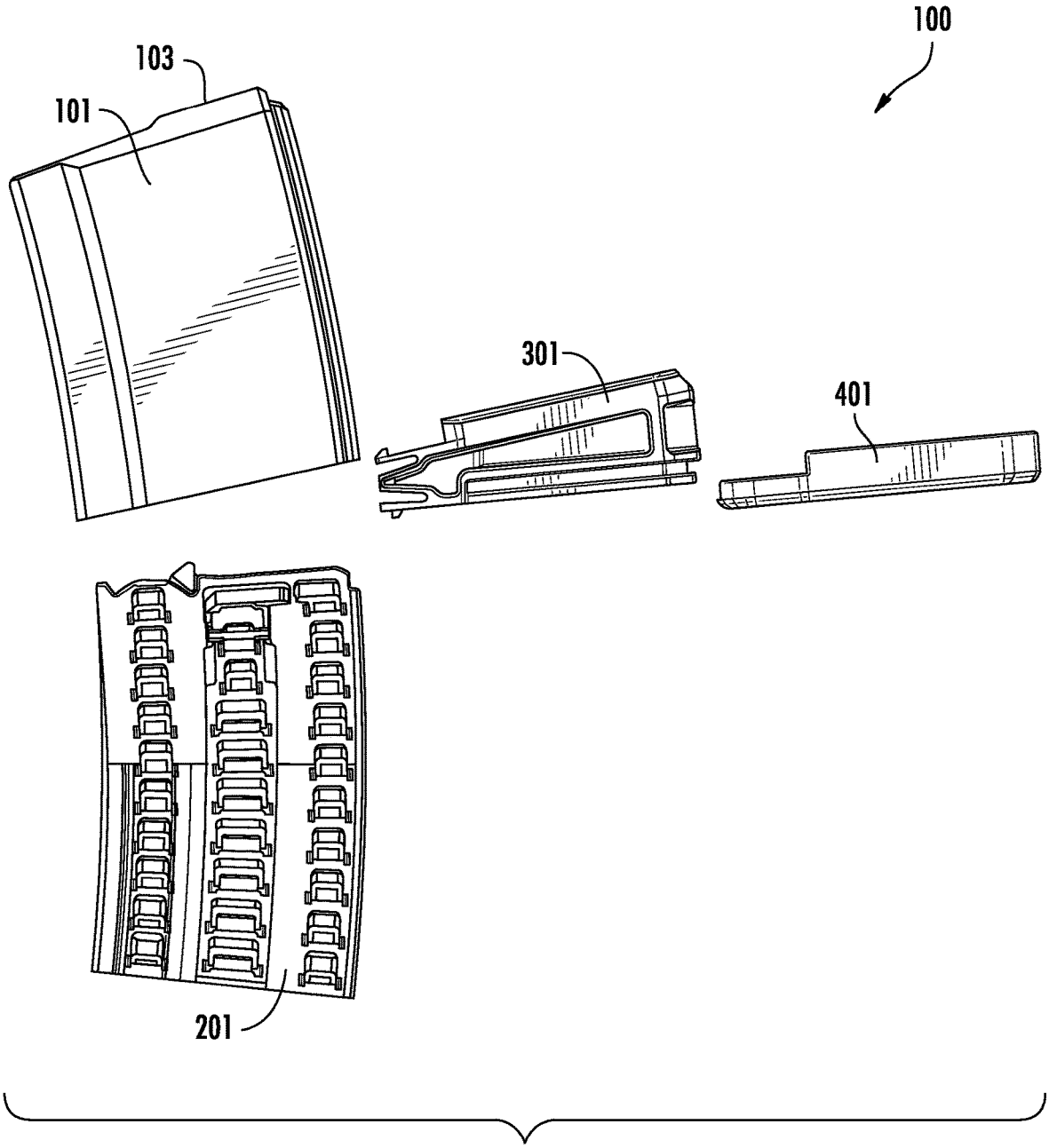
FIGS. 2A and 2B are exploded perspective views of the ratcheting magazine of FIG. 1.
Figure 2B:
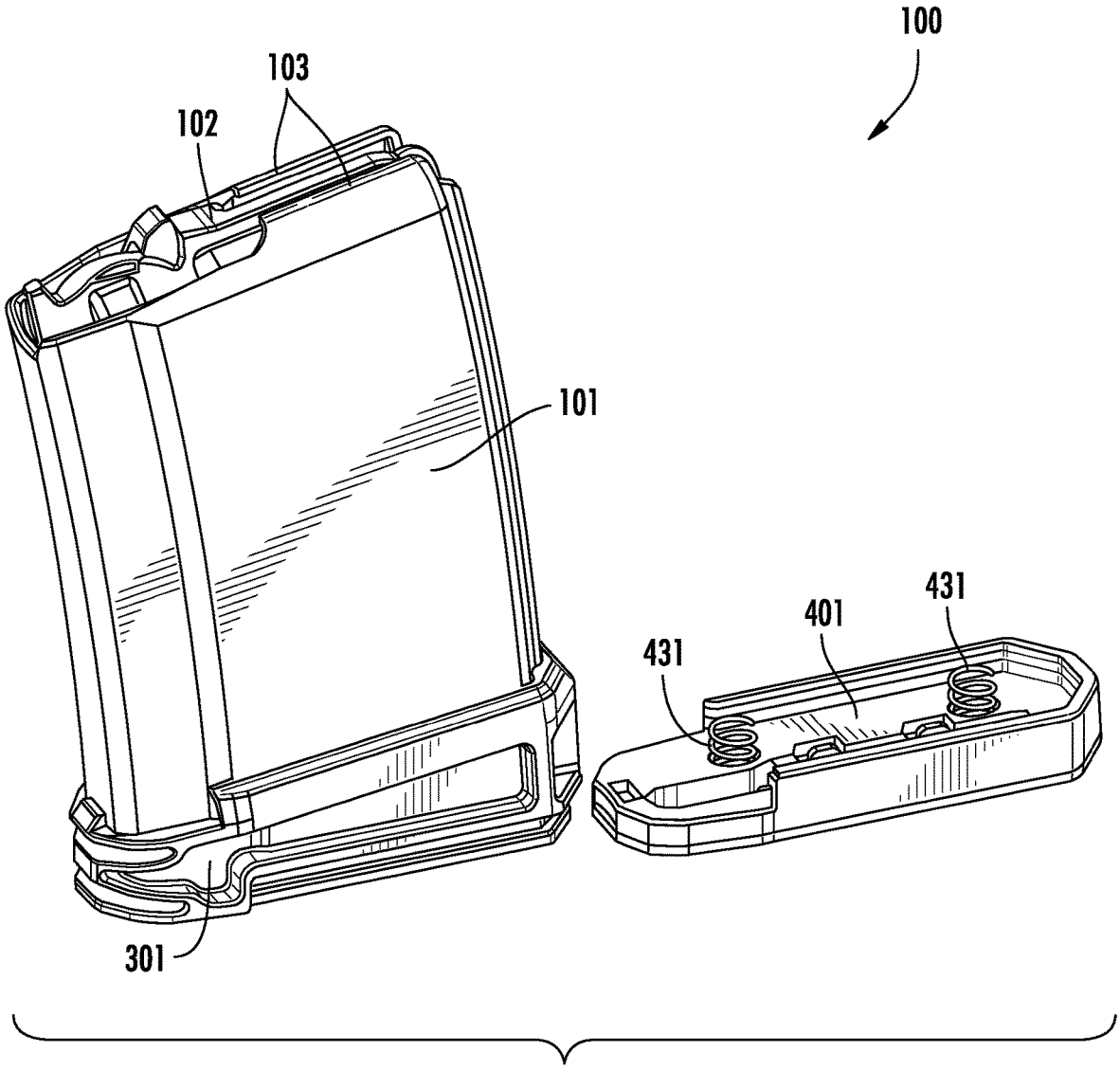

According to certain embodiments of the present invention, as shown in FIGS. 1-2B, a ratcheting magazine 100 may interface with a receiver of a firearm. The ratcheting magazine 100 may be a portable device capable of being inserted into and removed from a firearm (e.g., into a magazine well). In some embodiments, the ratcheting magazine 100 is permanently attached to a firearm as a fixed magazine. For example, the ratcheting magazine 100 may be fixed to a firearm using a lock as described in "FIREARM LOADER," U.S. application Ser. No. 15/845,209, filed on Dec. 18, 2017, the disclosure of which is incorporated herein in its entirety by this reference. The ratcheting magazine 100 facilitates the loading of at least one round of ammunition into the firearm. The ratcheting magazine 100 may facilitate loading of 5 rounds, 10 rounds, 20 rounds, 30 rounds, 40 rounds, or any other appropriate number of rounds.

In some embodiments, as shown in FIG. 2A, the ratcheting magazine 100 includes a main body 101, an insert 201 located inside the main body 101, an extension 301 attached to a lower end of the main body 101, and a floor plate 401 attached to a lower end of the extension 301. In certain embodiments, the floor plate 401 attached directly to the main body 101 (i.e., there is no extension). The main body 101 may include an opening 102 and at least one feed lip 103 at an upper end (see FIG. 1). The floor plate 401 may include an opening 403 such that a cartridge 10 may be inserted through the floor plate 401 into the ratcheting magazine 100 (see FIGS. 11A and 11B). The main body 101 may be configured such that the insert 201 may be located inside the main body 101 and a single stack of cartridges 10 may be arranged adjacent to the insert 201 inside the main body 101. In other embodiments, the main body 101 and insert 201 may be configured such that a double stack of cartridges 10 may be arranged within the main body 101 adjacent to the insert 201. In some embodiments, the main body 101 is a conventional magazine body with internal components (such as a conventional spring and follower) removed.

Unlike conventional magazines, which rely on a follower attached to a spring to push cartridges toward an opening of the magazine, the ratcheting magazine 100 uses a mechanical ratcheting system to move at least one cartridge toward the opening 102. In some examples, the ratcheting magazine 100 using a ratcheting system to move a cartridge 10 from bottom of the ratcheting magazine 100 to the upper end of the ratcheting magazine 100. In some embodiments, a user may insert multiple cartridges 10 sequentially through opening 403 such that each subsequent cartridge 10 pushes the previous cartridge(s) toward the opening 102. Unlike conventional magazine (that have followers attached to springs), the ratcheting magazine 100 may have at least one cartridge inside the ratcheting magazine 100 but not at the top of the magazine (i.e., such that there is a gap between the uppermost cartridge and the top of the magazine). The ratcheting system may operate based on input received from the firearm including, for example, based on movement of the bolt carrier group 20, as described in greater detail below. The ratcheting magazine 100 may include an auxiliary input that allows a user to manually cycle the mechanism (e.g., when the bolt carrier group 20 is not moving and/or when the ratcheting magazine 100 is not attached to a firearm). Movement of the bolt carrier group 20 for operating the mechanism of the ratcheting magazine 100 may be caused by manual operation/movement of the bolt carrier group 20 (e.g., operating a charging handle and/or bolt release) or may be caused by cycling of the firearm after firing a projectile. In some embodiments, the ratcheting magazine 100 may rely on at least one spring to reset the mechanism between cycles of the mechanism. In other embodiments, the mechanism may include a cam system to reset the mechanism between cycles (i.e., no springs necessary).

Figure 11A:
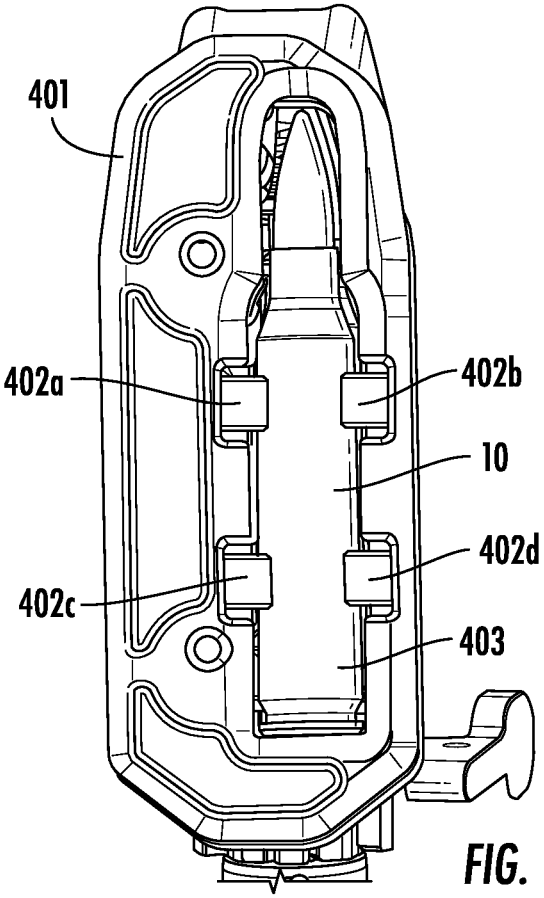
FIG. 11A is a bottom view of the ratcheting magazine of FIG. 1.
Figure 11B:
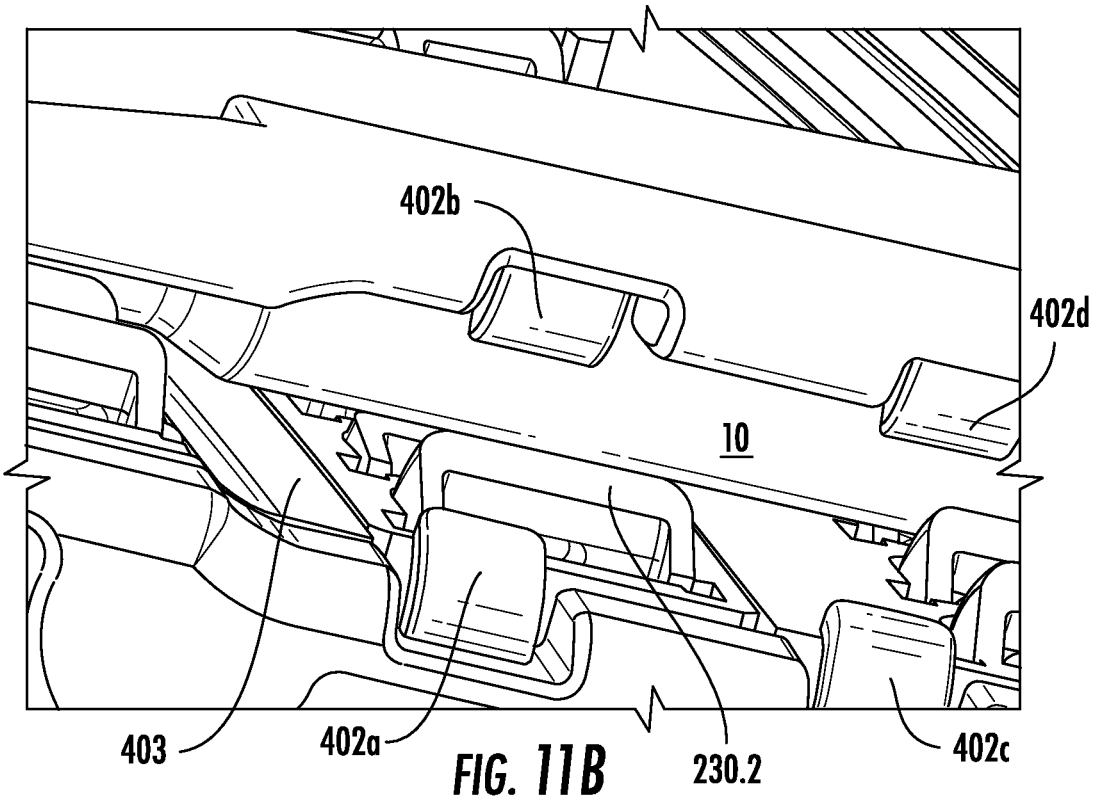
FIG. 11B is a partial bottom perspective view of the ratcheting magazine of FIG. 1.

The floor plate 401 may include at least one arm 402 for guiding cartridges 10 into the ratcheting magazine 100 and/or restricting movement of cartridges 10 out of the ratcheting magazine 100. As shown in FIGS. 11A and 11B, the floor plate 401 may include four arms 402*a*, 402*b*, 402*c*, and 402*d*. The arms 402*a*-402*d* may include a deployed position (as shown in FIGS. 11A and 11B) and a retracted position (not shown). The deployed position, which is shown in FIGS. 11A and 11B, limits the size of the opening 403 and prevents a cartridge located inside the ratcheting magazine 100 from passing through the opening 403. In some embodiments, the arms 402*a*-402*d* move/pivot from the deployed position toward the retracted configuration such that the distal end of each arm moves/rotates upward into the interior of the ratcheting magazine 100. The arms 402*a*-402*d* may be configured such that they can move inward toward the retracted position but cannot move/rotate beyond the deployed position (i.e., they cannot rotate downward or toward the exterior of the ratcheting magazine 100 beyond the illustrated deployed configuration). Movement to the retracted configuration allows a user to insert at least one cartridge 10 through the opening 403. In some embodiments, the movement of the arms 402*a*-402*d* is biased by a spring or other device toward at least one of the deployed position and the retracted position. The arms 402*a*-402*d* may have an arcuate curved shape as illustrated. In other embodiments, the arms 402*a*-402*d* may have a more rectilinear shape or any other appropriate shape.

Figure 3A:
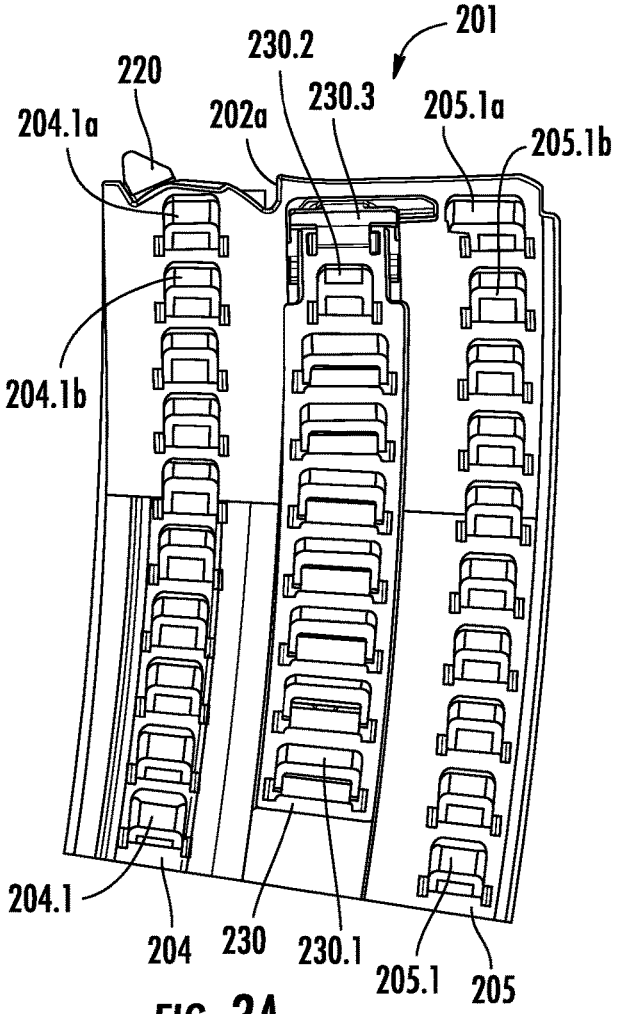
FIGS. 3A and 3B are front views of an insert of the ratcheting magazine of FIG. 1.
Figure 3B:
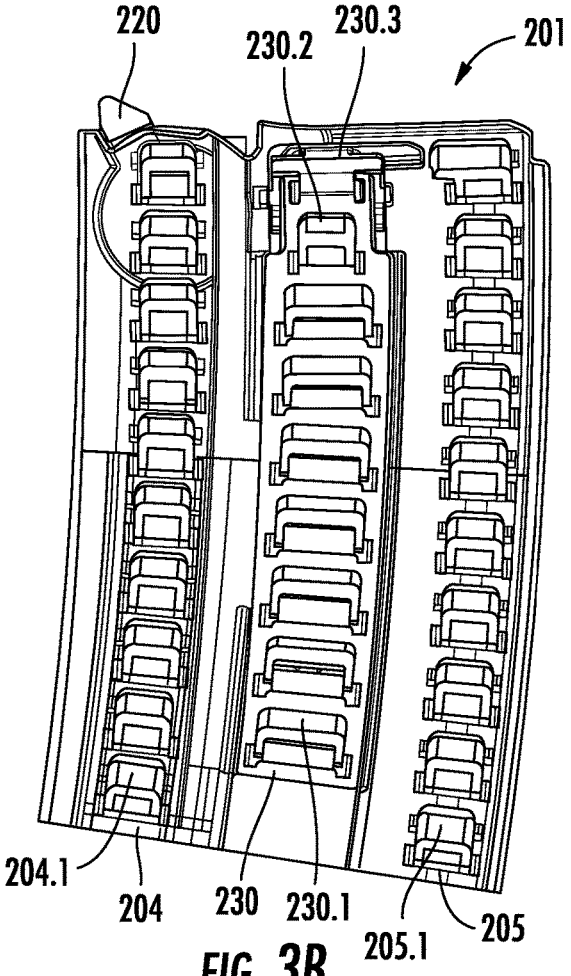
Figure 3C:
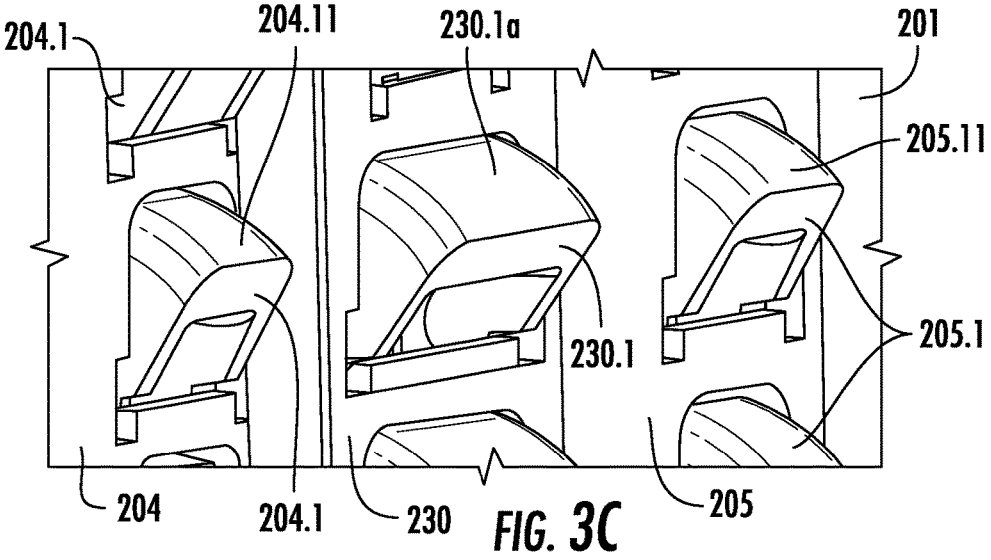
FIG. 3C is a partial front perspective view of the insert of FIG. 3A.

As shown in FIGS. 3A-3C, the insert 201 may include a rotating actuator 220 and multiple columns of moveable supports. As shown in the drawings, the rotating actuator 220 may include a protrusion that extends upward from the top of the ratcheting magazine 100. For example, the insert 201 may include a sliding column 230, a front column 204, and a rear column 205. Each column may include a plurality of moveable supports. For example, the sliding column 230 may include a plurality of first moveable supports 230.1, an upper support 230.3, and a middle support 230.2. The front column 204 may include a plurality of front supports 204.1, and the rear column 205 may include a plurality of rear supports 205.1. In some embodiments, the front supports 204.1 and the rear supports 205.1 are the same size and/or are a common part. The middle support 230.2 may also be the same size and/or are a common part with the front and rear supports 204.1, 205.1. Each of the supports (230.1, 230.2, 230.3, 204.1, 205.1) may have a retracted position and a deployed position. One example of a deployed position is shown in FIG. 3C where the supports pivot about an axis near the bottom of each respective support. In other embodiments, the supports may move linearly and, in some examples, move orthogonally to the surface of the insert 201. For the retracted position, although not shown, the supports move such that little or no part of the respective support extends beyond the surface of the insert 201. In some embodiments, when in the retracted position, the support is parallel to and/or coplanar with the surface of the insert 201. For example, in the retracted position, first moveable supports 230.1 are parallel to and/or coplanar with the surface of sliding column 230, front supports 204.1 are parallel to and/or coplanar with the surface of front column 204, and rear supports 205.1 are parallel to and/or coplanar with the surface of rear column 205.

In some embodiments, the supports (230.1, 230.2, 230.3, 204.1, 205.1) are biased toward the deployed position (e.g., by a spring) but can be pushed toward the deployed position. The supports (230.1, 230.2, 230.3, 204.1, 205.1) may be separate components from the insert 201 or, in some examples, may each be a subcomponent of (i.e., integral to) the insert 201. For example, the supports (230.1, 230.2, 230.3, 204.1, 205.1) may be formed by cutting a profile out of the respective portion of the insert 201 while retaining a connection between the insert 201 and the support at the lower edge of the respective support (e.g., by creating a "living hinge" at the bottom edge of the support where the support and insert 201 are attached).

When the supports (230.1, 230.2, 230.3, 204.1, 205.1) are in the deployed position, the upper surface of the support may act as a "shelf" to support a cartridge 10 (see e.g., FIGS. 7, 9A-9C, 10A, 10B, and 11B). For example, as shown in FIG. 3C, top surface 230.1*a* of first moveable supports 230.1, top surface 204.11 of front supports 204.1, and/or top surface 205.11 of rear supports 205.1 may act as a shelf. Although, in some embodiments, these top surfaces (230.1*a*, 204.11, 205.11) are not perpendicular to the surface of the insert 201 (i.e., are not horizontal when the ratcheting magazine 100 is oriented vertically), the gap between the support (in the deployed position) and the opposite interior surface of the main body 101 is small enough that a cartridge 10 cannot pass below the support(s).

Figure 4A:
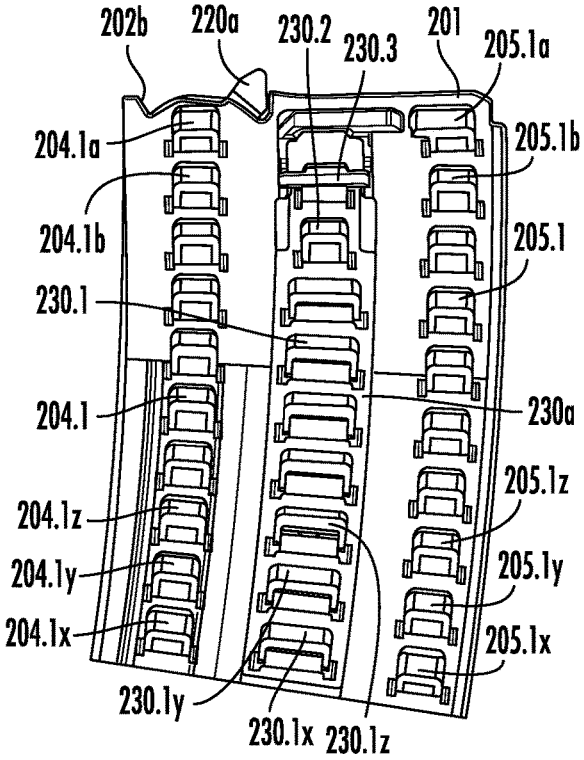
FIGS. 4A, 4B, 4C, and 4D are front views of the insert of FIG. 3A.
Figure 4B:
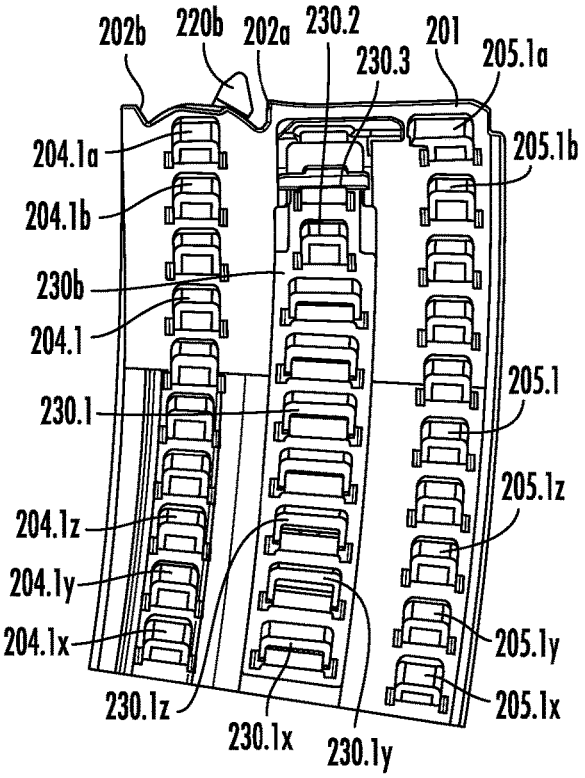
Figure 4C:
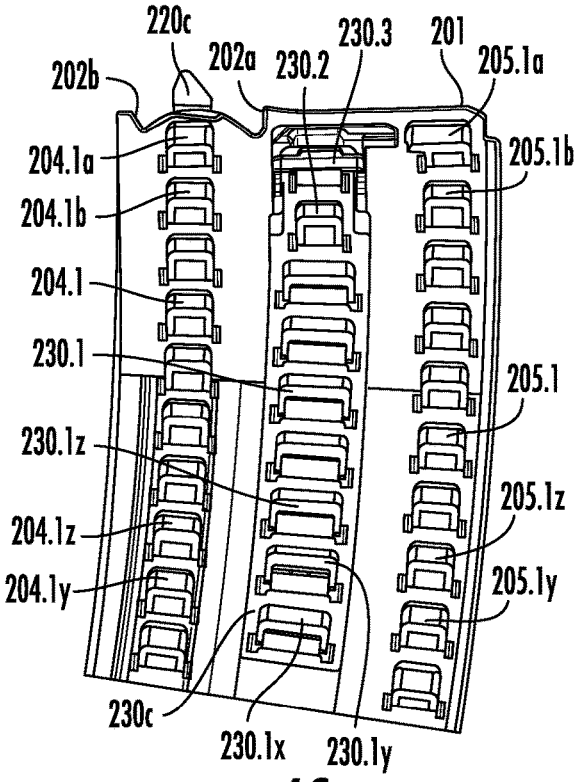
Figure 4D:
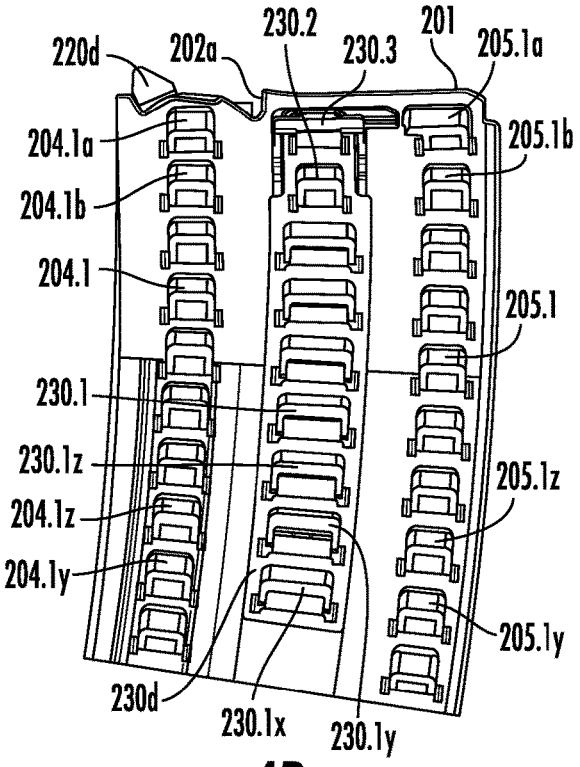
Figure 5A:
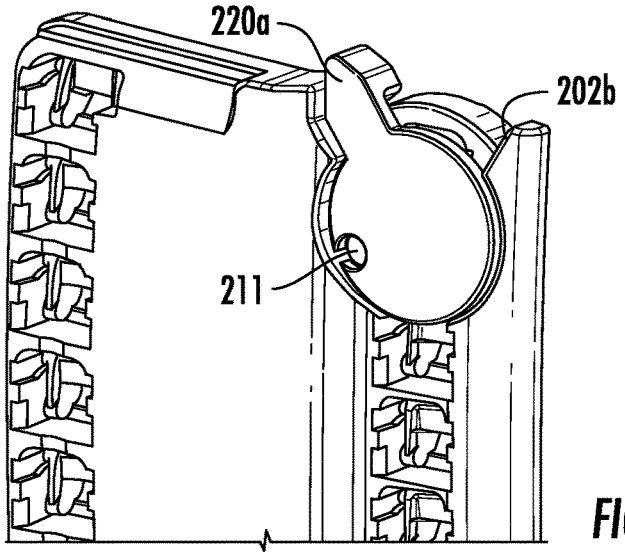
FIGS. 5A, 5B, and 5C are partial rear perspective views of the insert of FIG. 3A.
Figure 5B:
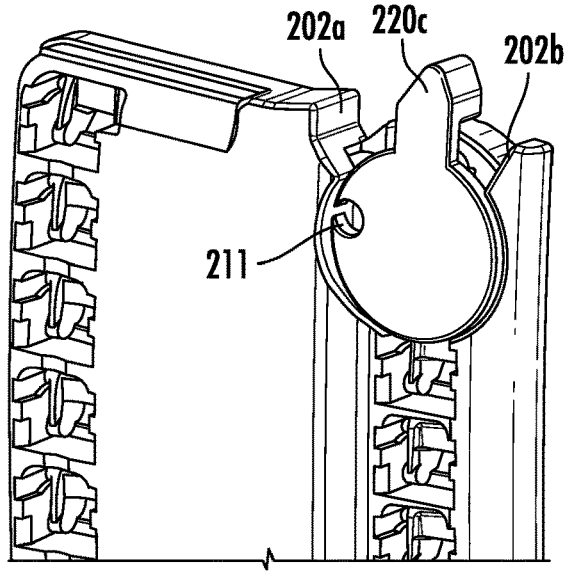
Figure 5C:
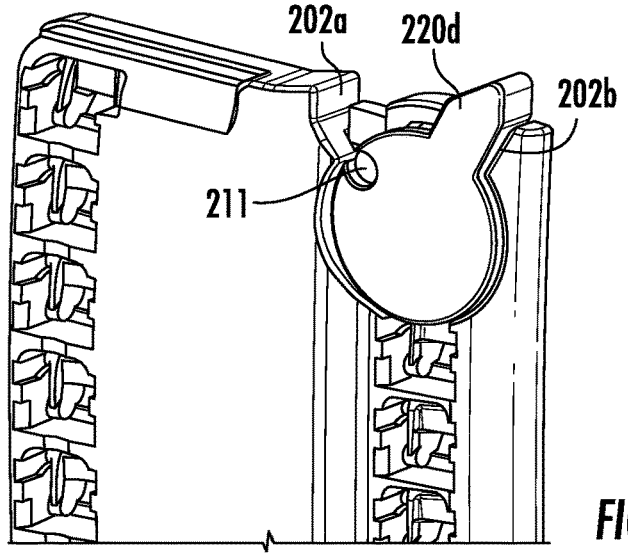

As shown in FIGS. 4A-4D, which show the front face of the insert 201, the sliding column 230 may move relative to the insert 201. The sliding column 230 may move linearly relative to the insert 201 (and relative to the front column 204 and the rear column 205). In other words, one or both of the front column 204 and the rear column 205 may be static relative to the insert 201. FIG. 4A shows the sliding column 230 at a lowermost position 230*a* relative to the insert 201. FIG. 4B shows the sliding column 230 at a first intermediate position 230*b* relative to the insert 201. FIG. 4C shows the sliding column 230 at a second intermediate position 230*c* (approximately halfway through its travel) relative to the insert 201. FIG. 4D shows the sliding column 230 at an uppermost position 230*d* relative to the insert 201. In some embodiments, the movement of the sliding column 230 is associated (and/or mechanically coupled) with movement of the rotating actuator 220. For example, as shown in FIG. 4A, when the sliding column 230 is in the lowermost position 230*a*, the rotating actuator 220 is in a rear position 220*a*. When the sliding column 230 is in the first intermediate position 230*b*, the rotating actuator 220 is in an intermediate position 220*b* (see FIG. 4B). As shown in FIG. 4C, when the sliding column 230 is in the second intermediate position 230*c*, the rotating actuator 220 is in an upright position 220*c*. When the sliding column 230 is in the uppermost position 230*d*, the rotating actuator 220 is in a front position 220*d* (see FIG. 4D). FIGS. 5A-5C show the back face of the insert 201 where the rotating actuator 220 is in the rear position 220*a*, the upright position 220*c*, and the front position 220*d*, respectively. In some embodiments, as shown in FIGS. 5A-5C, the rotating actuator 220 may include a hole 211 for creating a mechanical connection between the rotating actuator 220 and the sliding column 230 (i.e., for transferring the rotary motion of the rotating actuator 220 to the linear motion of the sliding column 230 or vice versa). In some embodiments, the rotating actuator 220 is biased toward one position by at least spring in the ratcheting magazine 100. For example, a spring 431 in the floor plate 401 may be configured to bias the rotating actuator 220 toward an equilibrium position. In some embodiments, the equilibrium position is upright position 220*c* (see FIG. 4C) while, in other embodiments, the equilibrium position is rear position 220*a* (see FIG. 4A).

Figure 6A:
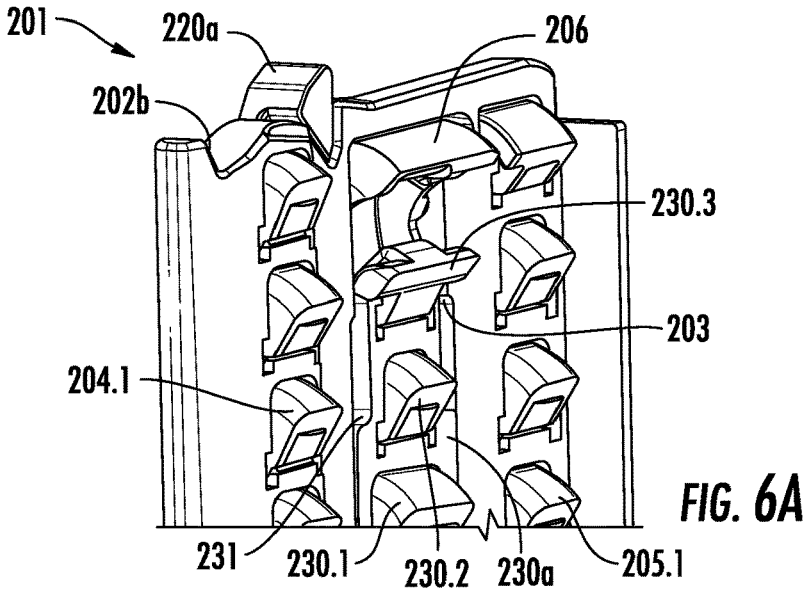
FIGS. 6A, 6B, and 6C are partial front perspective views of the insert of FIG. 3A.
Figure 6B:
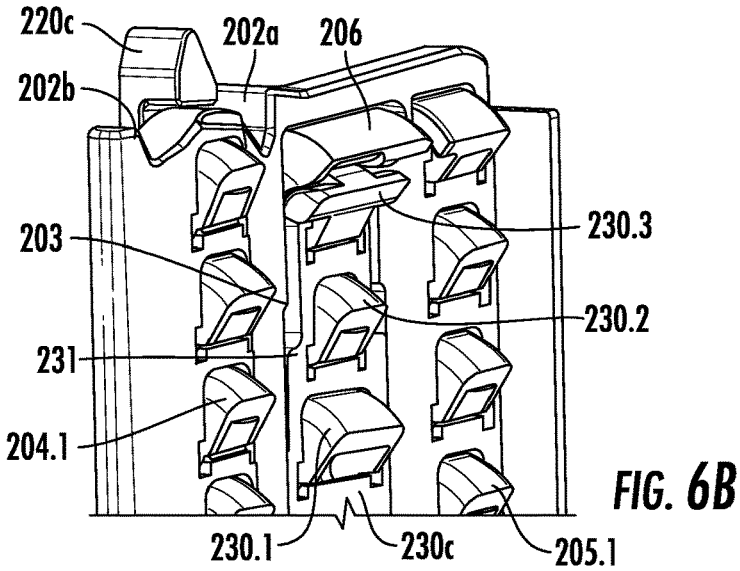
Figure 6C:
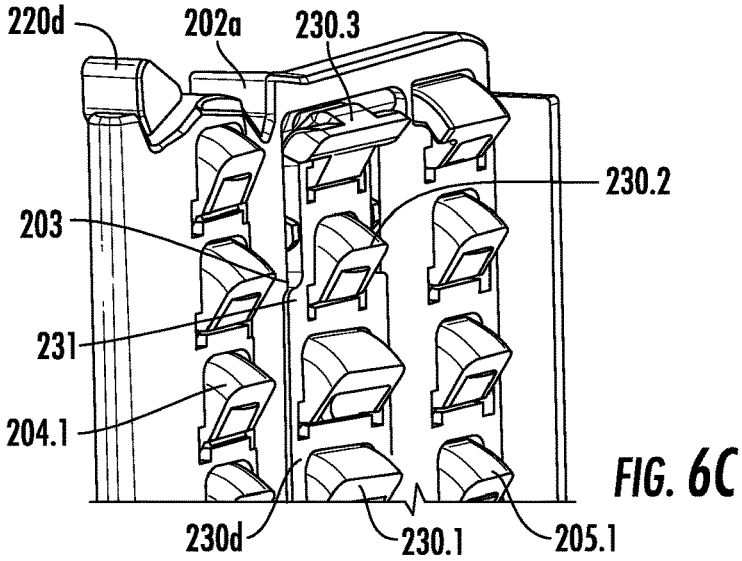

Motion of the rotating actuator 220 may be limited by constrained by features of the insert 201 in some embodiments. For example, as shown in FIGS. 4A-6C, the insert 201 may include a first stop portion 202*a* that interfaces with the protrusion of the rotating actuator 220 approximately at the rear position 220*a* of the rotating actuator 220 and a second stop portion 202*b* that interfaces with the protrusion of the rotating actuator 220 approximately at the front position 220*d* of the rotating actuator 220. In some embodiments, motion of the sliding column 230 may be limited by constrained by features of the insert 201. For example, as shown in FIGS. 6A-6C, the sliding column 230 may include at least one shoulder 231 and the insert 201 may include at least one protrusion 203. As shown in FIG. 6C, the at least one shoulder 231 may contact the at least one protrusion 203 when the sliding column 230 reaches the uppermost position 230*d*.

As shown in FIGS. 6A-6C, the insert 201 may include a center support 206 located above the sliding column 230. The center support 206 may be attached directly to the insert 201 such that it does not move with the sliding column 230 and is aligned with the uppermost front support 204.1 and the uppermost rear support 205.1. When the sliding column 230 is below the uppermost position 230*d*, a cartridge 10 may rest on the upper surfaces of the center support 206, the uppermost front support 204.1, and the uppermost rear support 205.1. When the sliding column 230 reaches the uppermost position 230*d*, the upper support 230.3 may cause the center support 206 to collapse to the retracted position (see FIG. 6C).

Figure 7:
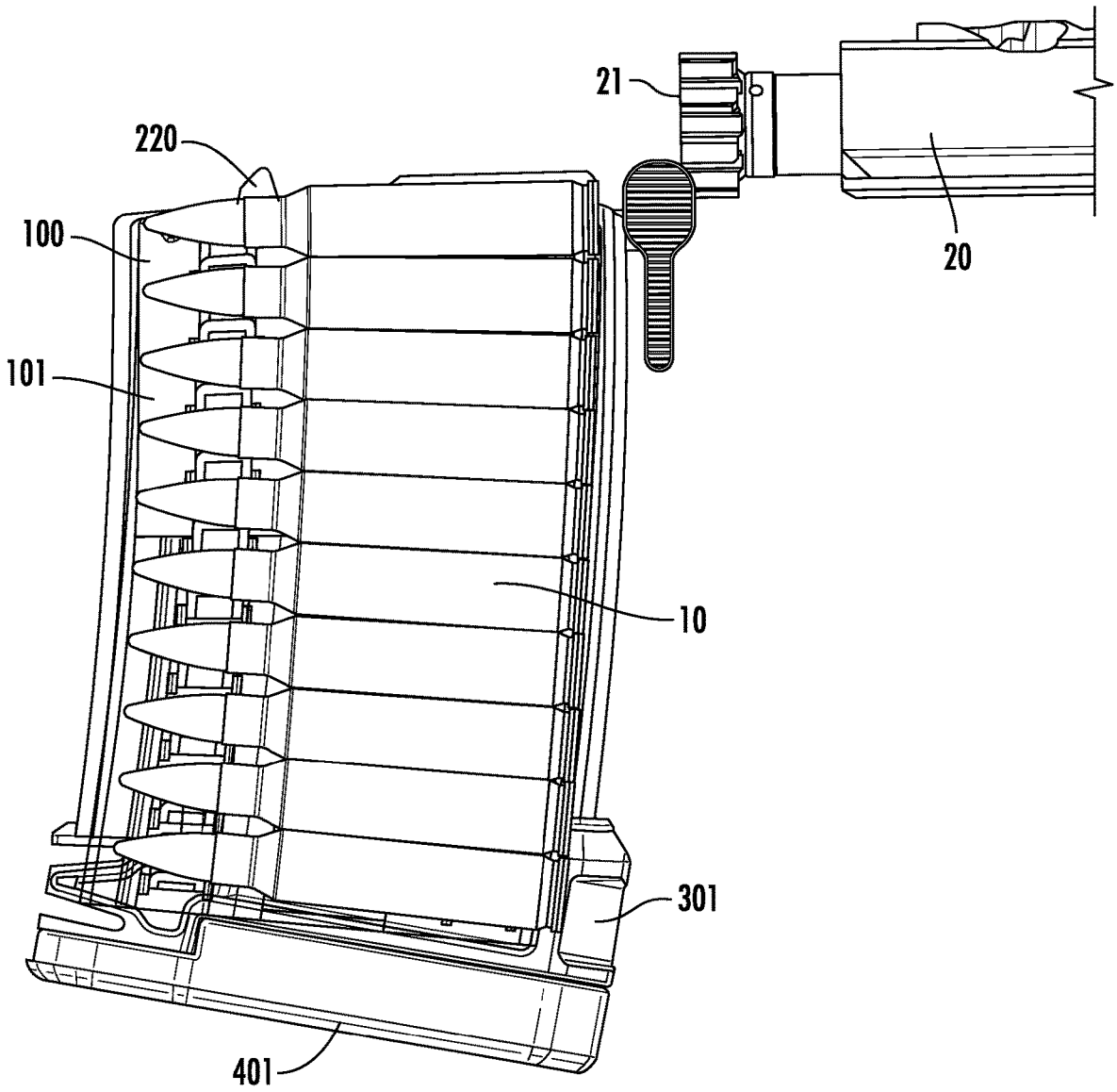
FIG. 7 is a front view of the ratcheting magazine of FIG. 1.

FIG. 7 shows the ratcheting magazine 100 (where the main body 101 is partially transparent) with a plurality of cartridges 10 therein such there is a cartridge for each row of supports (i.e., the ratcheting magazine 100 is at maximum capacity). The ratcheting magazine 100 is shown in the context of a firearm (not shown) when the bolt carrier group 20 is in a rear position. In some embodiments, when the bolt carrier group 20 moves forward and a cartridge 10 is located in the top row of supports, the leading edge 21 of the bolt carrier group 20 pushes the cartridge 10 out of the magazine and toward the chamber of the firearm (not shown). However, in addition, the leading edge 21 of the bolt carrier group 20 may also contact the protrusion of the rotating actuator 220. In some embodiments, the bolt carrier group 20 may also contact an upper edge of the insert 201 to cause movement of the insert 201 relative to the main body 101 (i.e., such movement would cause each of the sliding column 230, the front column 204, and the rear column 205 to move).

Figure 8A:
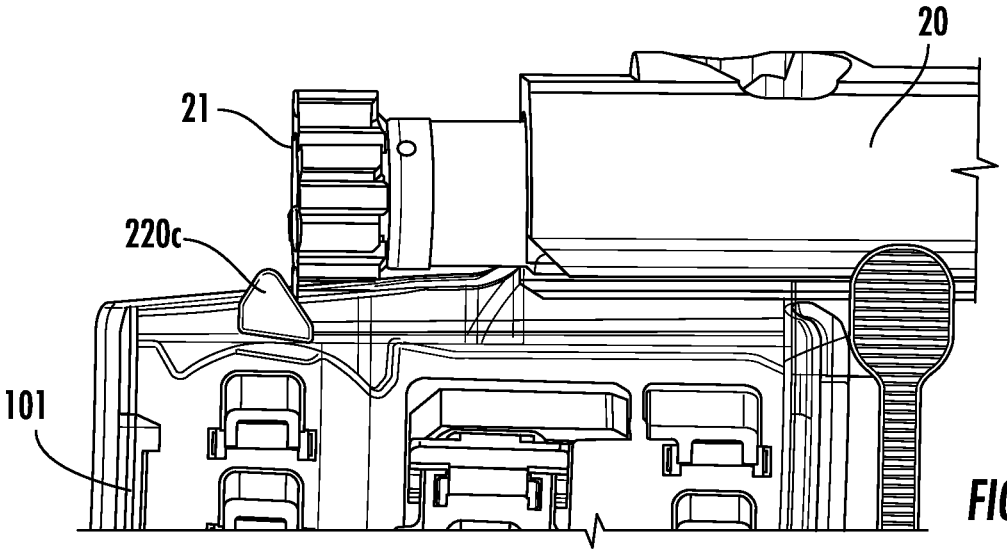
FIG. 8A is a partial front view of the ratcheting magazine of FIG. 1.
Figure 8B:
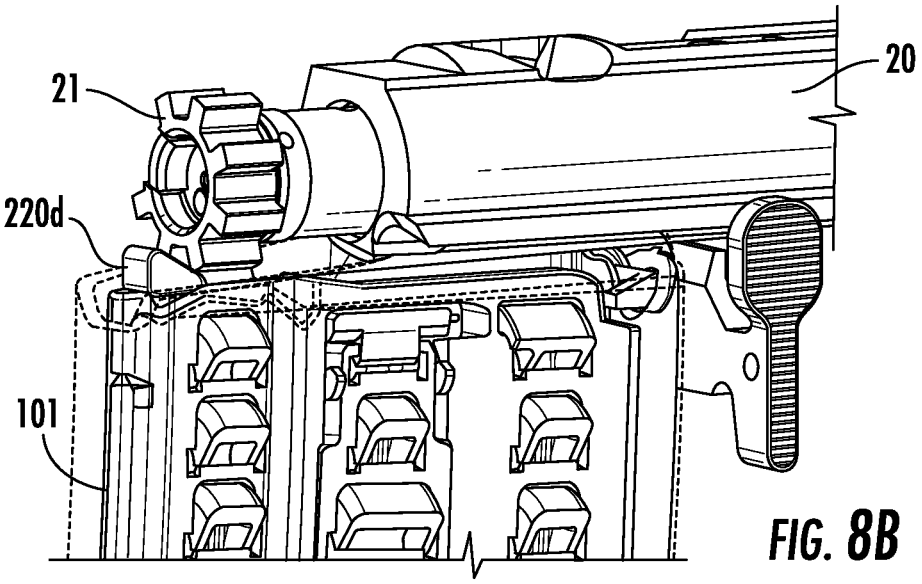
FIG. 8B is a partial front perspective view of the ratcheting magazine of FIG. 1.
Figure 8C:
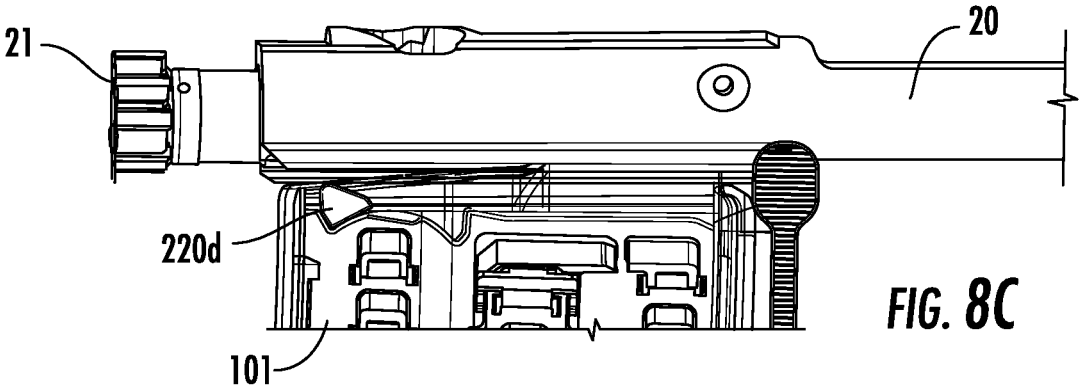
FIG. 8C is a partial front view of the ratcheting magazine of FIG. 1.

FIGS. 8A-8C show progress of the bolt carrier group 20 moving forward and interacting with the ratcheting magazine 100 (where no cartridges are present in the ratcheting magazine 100 and the main body 101 is partially transparent). The bolt carrier group 20 moves forward and contacts the rotating actuator 220 at the equilibrium position, which may be the upright position 220*c* (as shown in FIG. 8A), the rear position 220*a*, or any other appropriate position. FIG. 8A shows the leading edge 21 of the bolt carrier group 20 contacting the rotating actuator 220 at the upright position 220*c*, which may be the initial contact between the bolt carrier group 20 and the rotating actuator 220 (if the upright position 220*c* is the equilibrium position). If the equilibrium position of the rotating actuator 220 is the rear position 220*a*, the configuration shown in FIG. 8A occurs after the leading edge 21 of the bolt carrier group 20 has already pushed the rotating actuator 220 approximately halfway through the range of motion of the rotating actuator 220. The position of the rotating actuator 220 shown in FIG. 8A corresponds to the second intermediate position 230*c* of the sliding column 230, which is approximately halfway through the travel of the sliding column 230 (see FIG. 4C). As shown in FIG. 8B, the bolt carrier group 20 continues moving forward and pushes the rotating actuator 220 to the front position 220*d*. The position of the rotating actuator 220 shown in FIG. 8B corresponds to the uppermost position 230*d* of the sliding column 230, which is shown in FIG. 4D. As shown in FIG. 8C, after the rotating actuator 220 reaches the front position 220*d*, the bolt carrier group 20 continues moving to the forward/closed position. In some embodiments, after the leading edge 21 of the bolt carrier group 20 moves forward of the rotating actuator 220, the rotating actuator 220 is held in the front position 220*d* by an outer surface of the bolt carrier group 20.

Figure 9A:
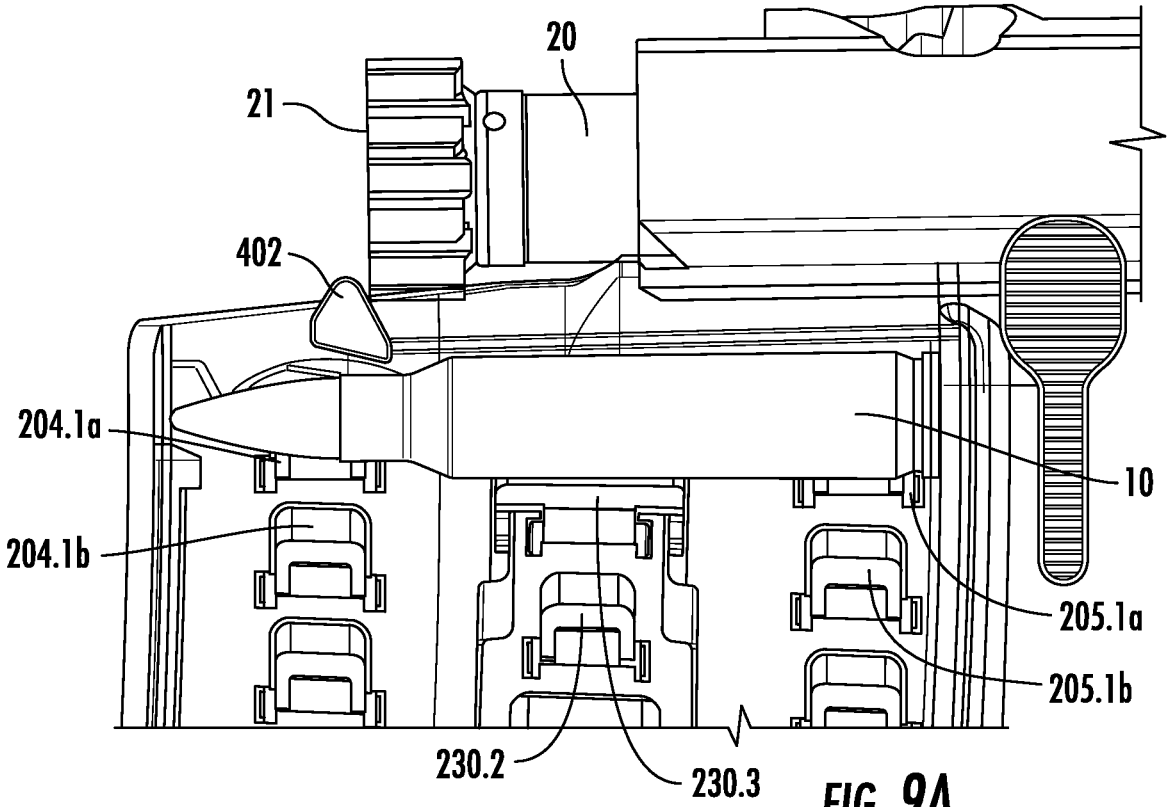
FIGS. 9A and 9B are partial front views of the ratcheting magazine of FIG. 1.
Figure 9B:
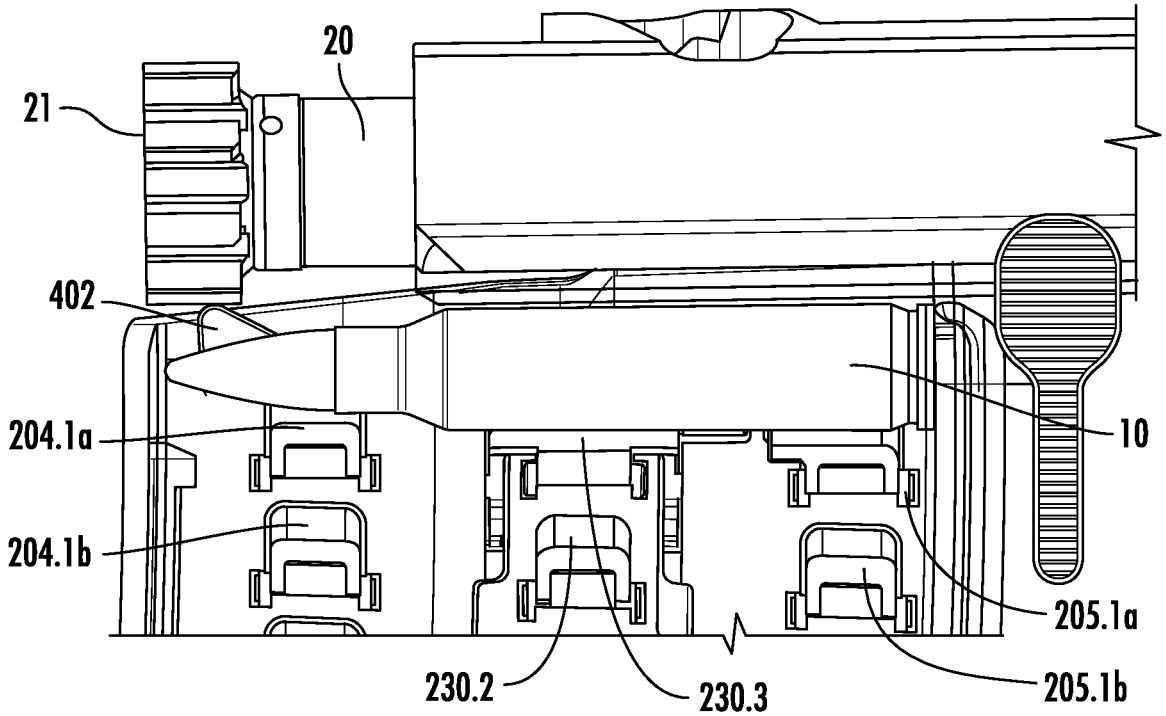

FIGS. 9A and 9B show the interaction of the bolt carrier group 20 and a portion of the ratcheting magazine 100, which causes a cartridge 10 to finish moving from the second highest row of supports to the top row of supports (where the main body 101 is partially transparent). FIG. 9A is similar to FIG. 8A where the rotating actuator 220 is located at the upright position 220*c* and the sliding column 230 is in the second intermediate position 230*c*. In some embodiments, before the sliding column 230 reaches the second intermediate position 230*c*, the sliding column 230 begins in the lowermost position 230*a* (see FIG. 4A). When the sliding column 230 is in the lowermost position 230*a*, the cartridge 10 (shown in FIGS. 9A and 9B) is located on the second highest row of supports such that the cartridge 10 is supported by support 204.1*b*, upper support 230.3, and support 205.1*b* (see FIG. 4A). In this configuration, the upper support 230.3 (which moves with sliding column 230) is approximately aligned with support 204.1*b* and support 205.1*b*. When the sliding column 230 begins moving upward (i.e., toward first intermediate position 230*b* and second intermediate position 230*c*), the upper support 230.3 moves upward relative to support 204.1*b* and support 205.1*b* (e.g., see FIGS. 4B and 4C). FIG. 9A (which corresponds to FIG. 4C) shows the sliding column 230 in the second intermediate position 230*c*. In FIG. 9A, the upper support 230.3 has lifted the cartridge 10 above support 204.1*b* and support 205.1*b*. As the cartridge 10 is raised away from support 204.1*b* and support 205.1*b*, the cartridge 10 pushes support 204.1*a* and support 205.1*a* toward their respective retracted positions (as shown in FIG. 9A). When the upper support 230.3 (moving with sliding column 230) lifts the cartridge 10 to a sufficient height, the support 204.1*a* and the support 205.1*a* each move to their respective deployed positions to support the cartridge in the top row of supports (see FIG. 9B). In some embodiments, the upper support 230.3 moves the cartridge 10 higher than the support 204.1*a* and the support 205.1*a* to allow the supports to move to their respective deployed positions. The extra height that allows for movement from the retracted position to the deployed position may be created by (1) movement of the sliding column 230 (i.e., the entire sliding column 230 moves a sufficient excess amount in the vertical direction, which is consistent for all supports 230.1, 230.2, 230.3); (2) geometric feature(s) of the individual supports of the sliding column 230; or (3) any other appropriate arrangement. Once the cartridge 10 reaches the top row of supports (as shown in FIG. 9B), the next time the leading edge 21 of the bolt carrier group 20 moves from the rear position (as shown in FIG. 7) forward, the leading edge 21 will engage the rear end of the cartridge 10 and push the cartridge 10 out of the magazine and toward the chamber of the firearm (not shown).

Figure 10A:
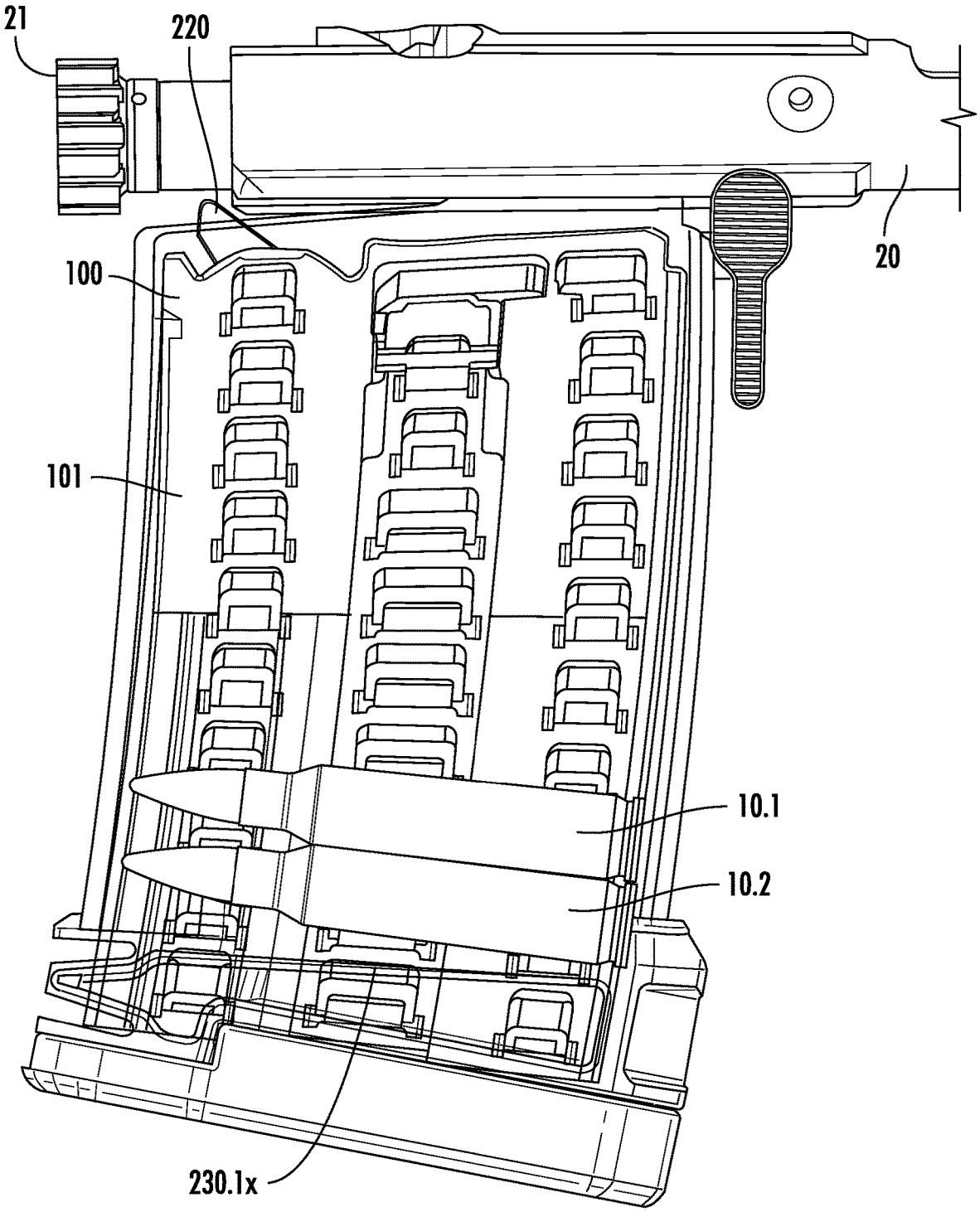
FIGS. 10A, 10B, and 10C are front views of the ratcheting magazine of FIG. 1.
Figure 10B:
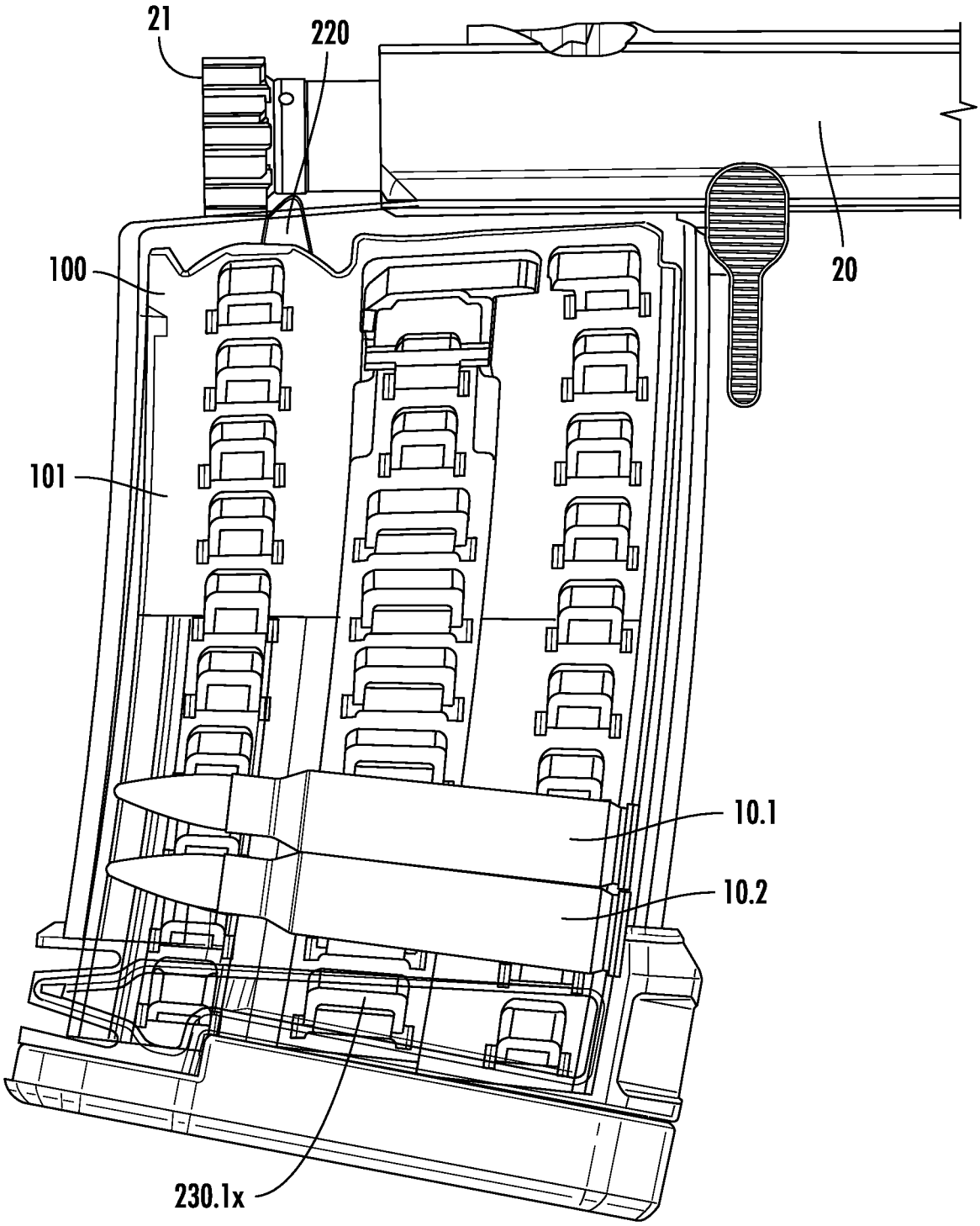
Figure 10C:
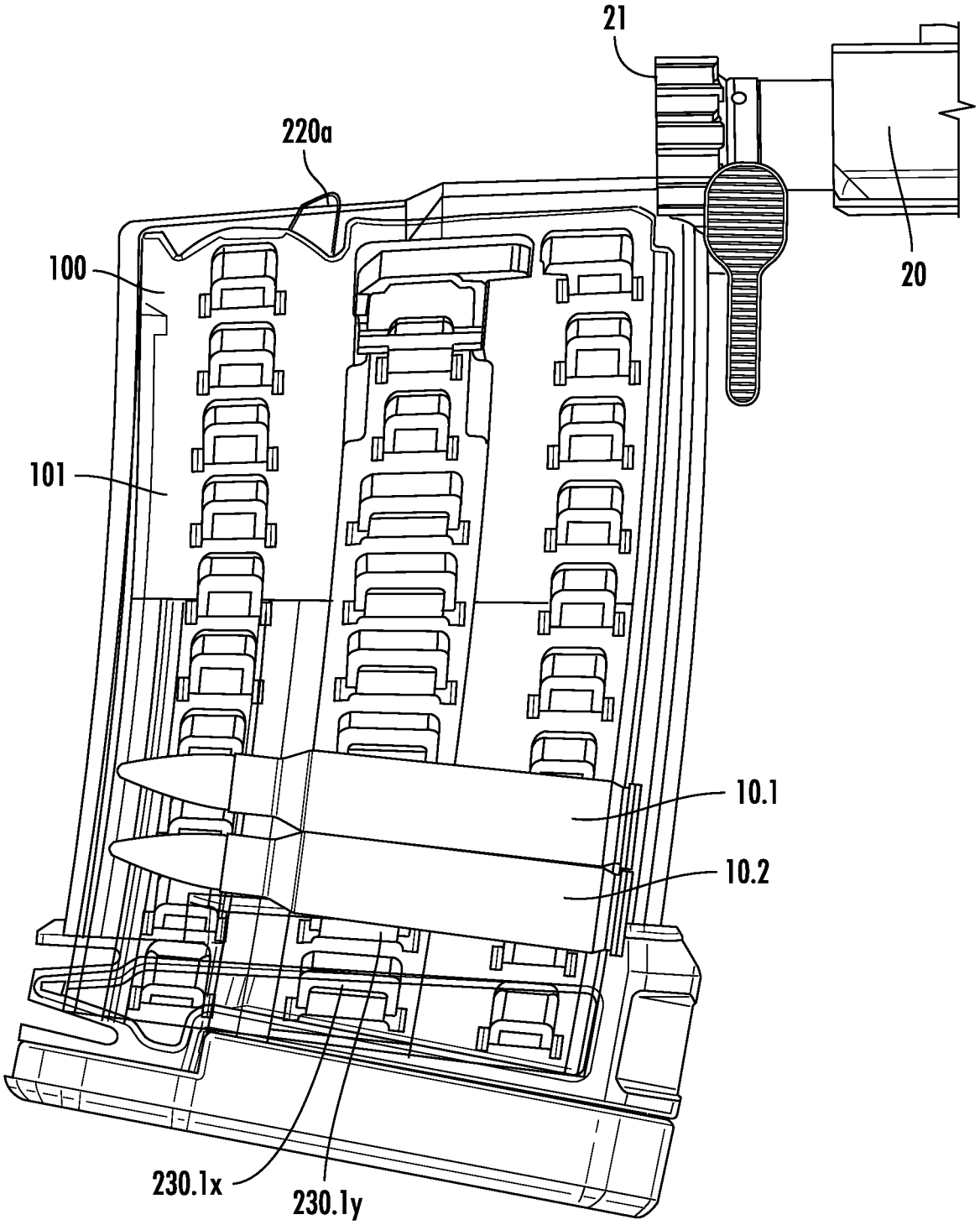

After the rotating actuator 220 is rotated toward the front position 220*d* and the sliding column 230 moves toward the uppermost position 230*d* (e.g., caused by movement of the bolt carrier group 20 moving forward), which is illustrated in FIGS. 8A-9B, the rotating actuator 220 may be rotated back toward the rear position 220*a* and the sliding column 230 may move back toward the lowermost position 230*a*. As shown in FIGS. 10A-10C, rotation of the rotating actuator 220 toward the rear position 220*a* and movement of the sliding column 230 toward the lowermost position 230*a* may be caused by rearward movement of the bolt carrier group 20. FIGS. 10A-10C show two cartridges 10.1 and 10.2 near the bottom of the ratcheting magazine 100 (where the main body 101 is partially transparent). In FIGS. 10A-10C, cartridge 10.1 is arranged in the third lowest row on support 204.1*z* and support 205.1*z* and cartridge 10.2 is arranged in the second lowest row on support 204.1*y* and support 205.1*y*. In some embodiments, these two cartridges 10.1, 10.2 remain stationary during the steps shown in FIGS. 10A-10C while the sliding column 230 moves downward. Some of these supports are obstructed in FIGS. 10A-10C by the cartridges but are illustrated in FIGS. 4A-4D. FIG. 10A illustrates the bolt carrier group 20 in the initial stages of moving rearward (see FIG. 8C for the forward-most position of the bolt carrier group 20). In FIG. 10A, the rotating actuator 220 is rotated slightly rearward of the front position 220*d* and the sliding column 230 has moved slightly down from the uppermost position 230*d*. When the sliding column 230 was in the uppermost position 230*d* (i.e., just before the configuration shown in FIG. 10A), support 230.1*x* was aligned with support 204.1*y* and support 205.1*y* and supported cartridge 10.2 (see FIG. 4D for alignment/configuration of supports). Similarly, in the uppermost position 230*d*, support 230.1*y* was aligned with support 204.1*z* and support 205.1*z* and supported cartridge 10.1 (see FIG. 4D for alignment/configuration of supports). In FIG. 10A, the sliding column 230 has moved slightly down such that support 230.1*x* is no longer supporting cartridge 10.2 and support 230.1*y* is no longer supporting cartridge 10.1. Because there is no cartridge below cartridge 10.2, support 230.1*x* remains in the deployed position. As the sliding column 230 moves down, the support 230.1*y* (which previously supported cartridge 10.1) is forced to move toward the retracted position as it is presses against cartridge 10.2 (i.e., moving to the retracted position will allow support 230.1*y* to move below cartridge 10.2). In addition, the support 230.1*z* (which previously did not support any cartridge) is forced to move toward the retracted position as it is presses against cartridge 10.1 (i.e., moving to the retracted position will allow support 230.1*z* to move below cartridge 10.1).

FIG. 10B illustrates a state where the bolt carrier group 20 has pushed the rotating actuator 220 rearward beyond the upright position 220*c* to approximately the same configuration that is illustrated in FIG. 4B (i.e., the rotating actuator 220 is approximately located at the intermediate position 220*b* and the sliding column 230 is approximately located at the first intermediate position 230*b*). As shown in FIG. 10B, support 230.1*x* is more noticeably offset from the bottom of cartridge 10.2 and remains in the deployed position. Support 230.1*y* (which previously supported cartridge 10.1) has moved further downward and remains in the retracted position as it is presses against cartridge 10.2. Support 230.1*z* remains in the retracted position as it is presses against cartridge 10.1.

FIG. 10C shows the ratcheting magazine 100 after the rotating actuator 220 has been moved rearward to the rear position 220*a* and the sliding column 230 been moved to the lowermost position 230*a* (see FIG. 4A for configuration of supports). In moving to lowermost position 230*a*, the sliding column 230 moved a sufficient distance such that (1) support 230.1*y* (which previously supported cartridge 10.1) has moved from the retracted position to the deployed position and is supporting cartridge 10.2 and (2) support 230.1*z* (which previously did not support any cartridge) has moved from the retracted position to the deployed position and is supporting cartridge 10.1. In addition, support 230.1*x* has moved down such that it is aligned with support 204.1*x* and support 205.1*x*. In some embodiments, supports 230.1*y*, 230.1*z* moves lower than the respective to allow the supports to move to their respective deployed positions. The extra height that allows for movement from the retracted position to the deployed position may be created by (1) movement of the sliding column 230 (i.e., the entire sliding column 230 moves a sufficient excess amount in the vertical direction, which is consistent for all supports 230.1, 230.2, 230.3); (2) geometric feature(s) of the individual supports of the sliding column 230; or (3) any other appropriate arrangement.

Once the ratcheting magazine 100 reaches the configuration illustrated in FIG. 10C (and in FIG. 4A), a subsequent forward cycle of the rotating actuator 220 (i.e., moving the rotating actuator 220 to the front position 220*d*) would raise cartridges 10.1, 10.2 to the next highest rows of the insert 201. For example, following a sequence similar to that shown in FIGS. 8A-8C and/or 9A-9B, would raise cartridge 10.2 from the row associated with supports 204.1*y* and 205.1*y* to the row associated with supports 204.1*z* and 205.1*z*.

The components of the ratcheting magazine 100 described herein may be formed of materials including, but not limited to, thermoplastic, carbon composite, plastic, nylon, steel, aluminum, stainless steel, high strength aluminum alloy, other plastic or polymer materials, other metallic materials, other composite materials, or other similar materials. Moreover, the components of the ratcheting magazine 100 may be attached to one another via suitable fasteners, which include, but are not limited to, screws, bolts, rivets, welds, co-molding, injection molding, or other mechanical or chemical fasteners.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A magazine for a firearm comprising:
a main body comprising an upper end and a lower end;
a first opening at the upper end of the main body such that cartridges exit the magazine through the first opening;
a floor plate at the lower end of the main body;
a second opening such that cartridges enter the magazine through the second opening; and
an insert disposed inside the main body, wherein:
the insert comprises a front column of supports, a rear column of supports, and a sliding column of supports.

2. The magazine of claim 1, wherein the sliding column of supports comprises a plurality of positions relative to the insert such that the sliding column of supports moves relative to the insert.

3. The magazine of claim 1, wherein the second opening is disposed at the lower end of the main body.

4. The magazine of claim 1, wherein the second opening is disposed in the floor plate.

5. The magazine of claim 1, wherein the insert is a separate component from the main body.

6. The magazine of claim 1, further comprising a plurality of arms adjacent to the second opening, wherein the plurality of arms restrict movement of cartridges out of the magazine.

7. The magazine of claim 1, wherein each of the supports of the front column of supports, the rear column of supports, and the sliding column of supports comprises a deployed position and a retracted position.

8. The magazine of claim 1, further comprising a rotating actuator that is mechanically linked to the movement of the sliding column.

9. The magazine of claim 8, wherein the rotating actuator comprises a hole for a mechanical connection between the rotating actuator and the sliding column.

10. The magazine of claim 8, wherein the rotating actuator comprises a protrusion extending upward from the magazine.

11. The magazine of claim 10, wherein the protrusion of the rotating actuator is configured to interface with a bolt carrier group when the magazine is inserted into the firearm.

12. The magazine of claim 11, wherein movement of the protrusion of the rotating actuator from a rear position to a front position causes the sliding column to move from a lowermost position to an uppermost position.

13. A magazine for a firearm comprising:
a main body;
a floor plate; and
a portion disposed inside the main body, wherein:
the portion comprises at least one static support and at least one sliding support;
the at least one sliding support comprises a plurality of positions relative to the portion such that the at least one sliding support moves relative to the portion;
each of the at least one static support comprises a deployed position and a retracted position; and
each of the at least one sliding support comprises a deployed position and a retracted position.

14. The magazine of claim 13, further comprising:
a first opening adjacent to an upper end of the main body such that cartridges exit the magazine through the first opening; and
a second opening separate from the first opening such that cartridges enter the magazine through the second opening.

15. The magazine of claim 14, wherein the second opening is disposed at the lower end of the main body.

16. The magazine of claim 14, wherein the second opening is disposed in the floor plate.

17. The magazine of claim 14, further comprising a plurality of arms adjacent to the second opening, wherein the plurality of arms restrict movement of cartridges out of the magazine.

18. The magazine of claim 13, wherein the portion is a separate component from the main body.

19. The magazine of claim 13, further comprising an actuator that is mechanically linked to the movement of the at least one sliding support.

20. A magazine for a firearm comprising:
a main body;
a floor plate;
a portion disposed inside the main body;

a first opening adjacent to an upper end of the main body such that cartridges exit the magazine through the first opening; and a second opening separate from the first opening such that cartridges enter the magazine through the second opening, wherein:

the portion comprises at least one static support and at least one sliding support; and the second opening is disposed in the floor plate.

* * * * *